US008801471B2

(12) United States Patent
Zhu et al.

(10) Patent No.: US 8,801,471 B2
(45) Date of Patent: Aug. 12, 2014

(54) USB CONNECTOR ASSEMBLY

(71) Applicants: Zhi-Ming Zhu, Wuhan (CN); Ting Wang, Wuhan (CN); Dan Yu, Wuhan (CN)

(72) Inventors: Zhi-Ming Zhu, Wuhan (CN); Ting Wang, Wuhan (CN); Dan Yu, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/664,609

(22) Filed: Oct. 31, 2012

(65) Prior Publication Data

US 2013/0164989 A1 Jun. 27, 2013

(30) Foreign Application Priority Data

Dec. 27, 2011 (CN) ..... 2011 1 0444402

(51) Int. Cl.
*H01R 24/00* (2011.01)

(52) U.S. Cl.
USPC ..... 439/660; 439/357

(58) Field of Classification Search
USPC ..... 439/345, 350–354, 357, 456, 660, 680
See application file for complete search history.

(56) References Cited

U.S. PATENT DOCUMENTS

| | | | | |
|---|---|---|---|---|
| 6,146,210 | A * | 11/2000 | Cha et al. | 439/680 |
| 6,485,194 | B1 * | 11/2002 | Shirakawa | 385/78 |
| 6,997,749 | B1 * | 2/2006 | Harubayashi | 439/607.45 |
| 8,262,403 | B2 * | 9/2012 | Slippy et al. | 439/353 |
| 8,517,756 | B2 * | 8/2013 | Song et al. | 439/357 |

* cited by examiner

*Primary Examiner* — Thanh Tam Le
(74) *Attorney, Agent, or Firm* — Novak Druce Connolly Bove + Quigg LLP

(57) ABSTRACT

A connector assembly includes a USB socket and a USB connector. The USB socket includes a housing and at least one engaging protrusion protruding from an inner surface of the housing. The USB connector includes a holding portion; a header adapted to be plugged into the USB socket which extends from a first end of the holding portion along a first direction; and a plurality of cables, extending from a second end of the holding portion along a second direction substantially perpendicular to the first direction. At least one groove is defined in the header for receiving the at least one engaging protrusion and preventing the header from accidentally disengaging from the USB socket.

13 Claims, 8 Drawing Sheets

USB CONNECTOR ASSEMBLY

BACKGROUND

1. Technical Field

The present disclosure relates to a USB connector assembly.

2. Description of Related Art

A USB connector assembly of related art includes a USB socket attached on a motherboard of a computer and a USB connector capable of mating with the USB socket. A circular arc-shaped protrusion protrudes from the USB connector. An arc-shaped slot is defined in the USB socket. When the USB connector is inserted into the USB socket, the arc-shaped protrusion engages the arc-shaped slot for retaining the USB connector in the USB socket. However, the latching is not strong, and the USB connector is still easily disengaged from the USB socket.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation. In the figures of the accompanying drawings, like references indicate similar elements. It should be noted that references to "an" or "one" embodiment in this disclosure are not necessarily to the same embodiment, and such references mean "at least one."

Figure 1:
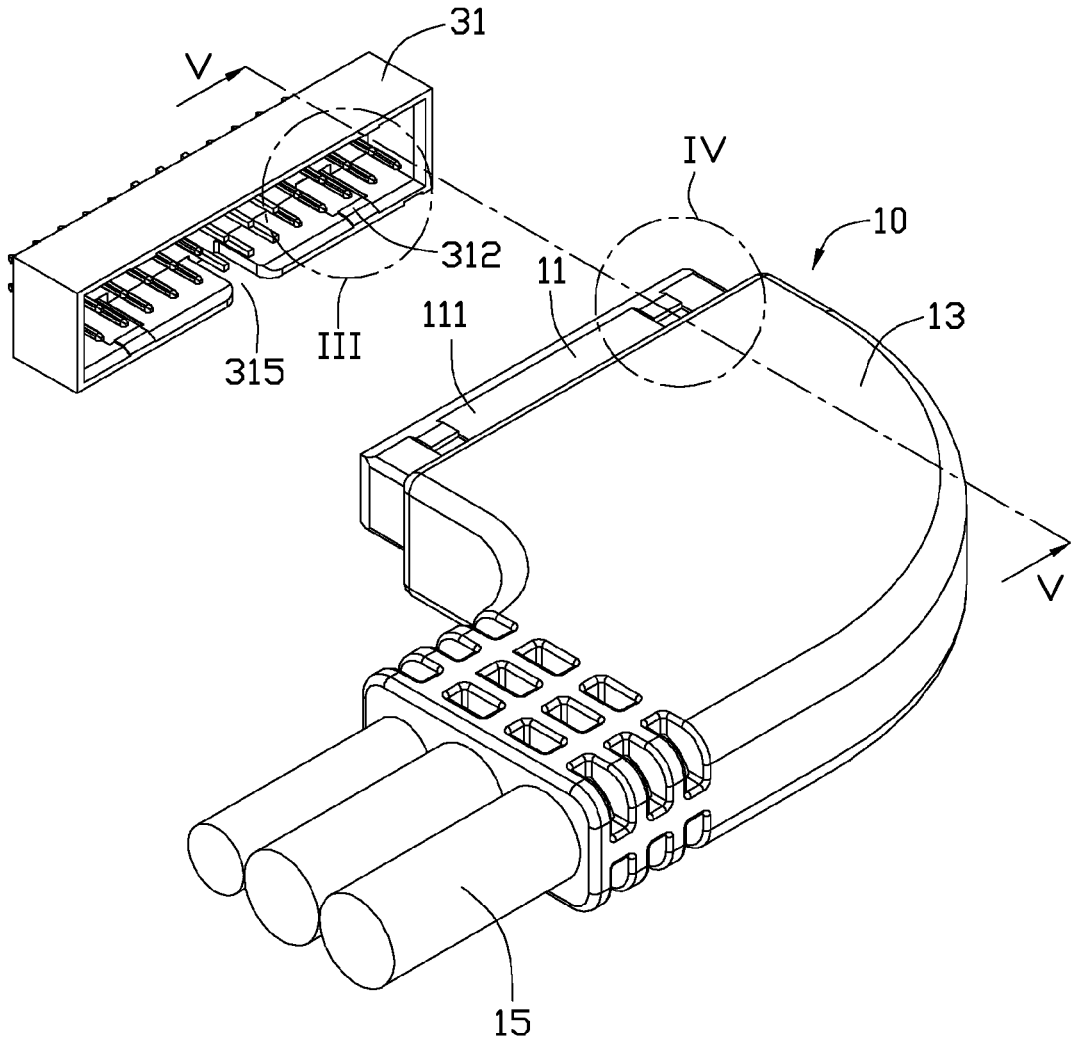
FIG. 1 is an isometric, exploded view of a USB connector assembly in accordance with an embodiment.
Figure 2:
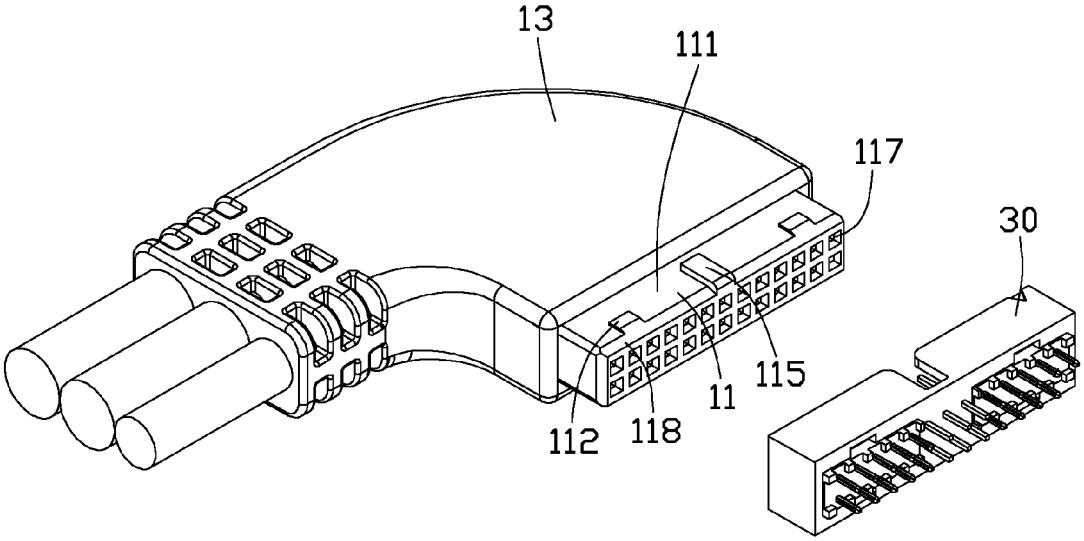
FIG. 2 is similar to FIG. 1, but viewed from another aspect.

Referring to FIGS. 1 and 2, an embodiment of a USB connector assembly includes a USB connector 10 and a USB socket 30, adapted to receive the USB connector 10. In one embodiment, the USB socket 30 is mounted on a motherboard (not shown). The USB connector 10 is adapted to connect an external USB device to the USB socket 30.

Figure 3:
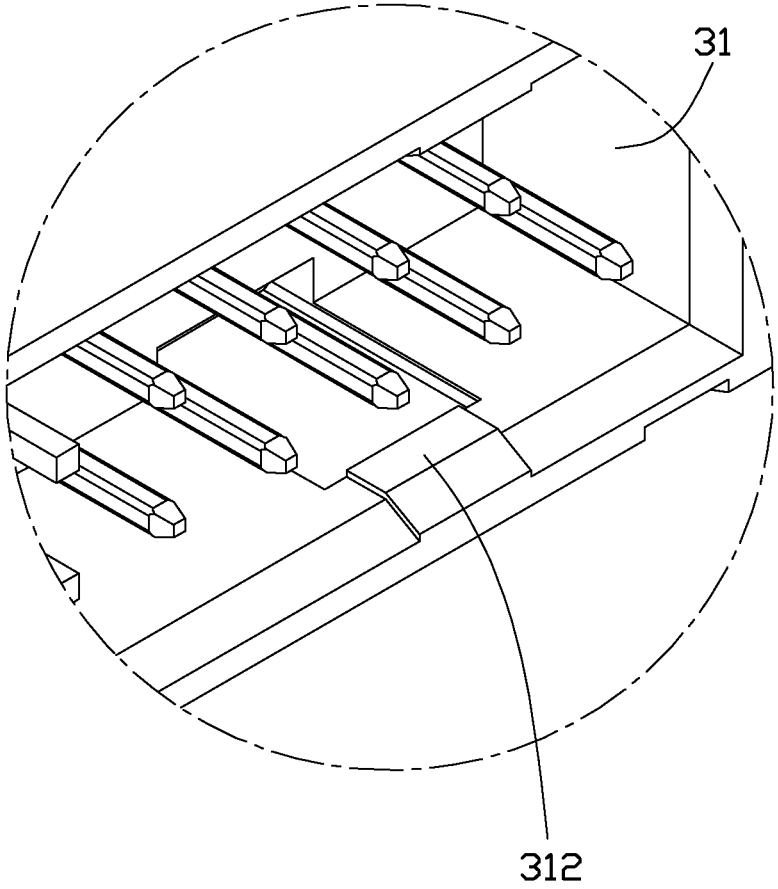
FIG. 3 is an enlarged view of a circled portion III of FIG. 1.
Figure 4:
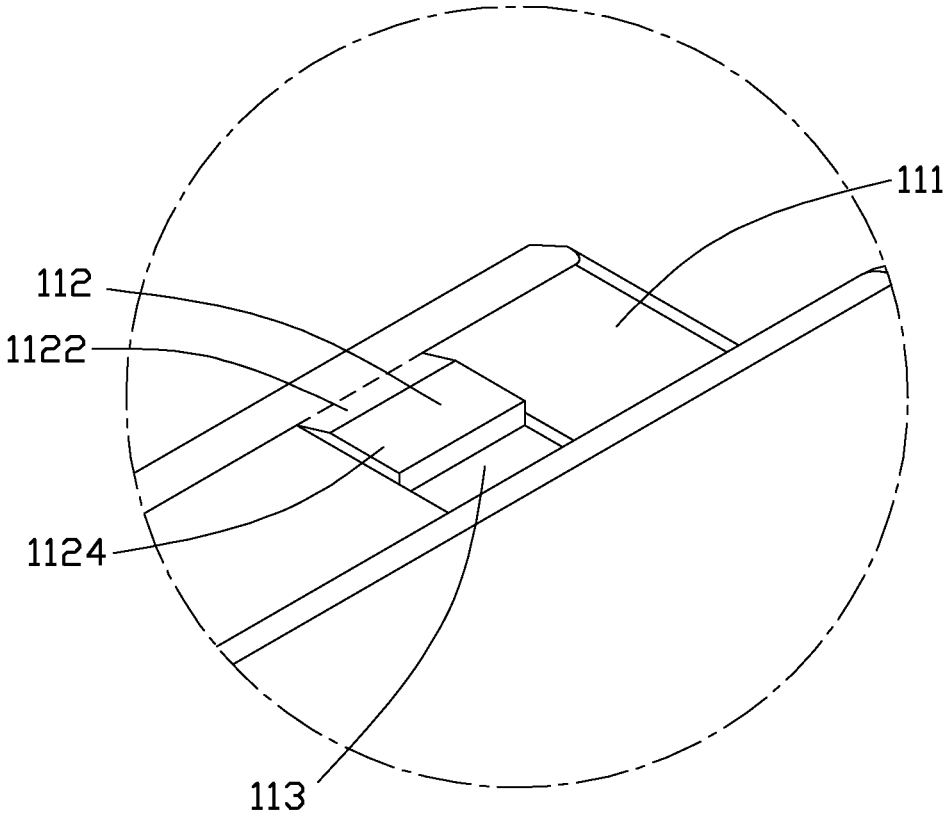
FIG. 4 is an enlarged view of a circled portion IV of FIG. 1.
Figure 5:
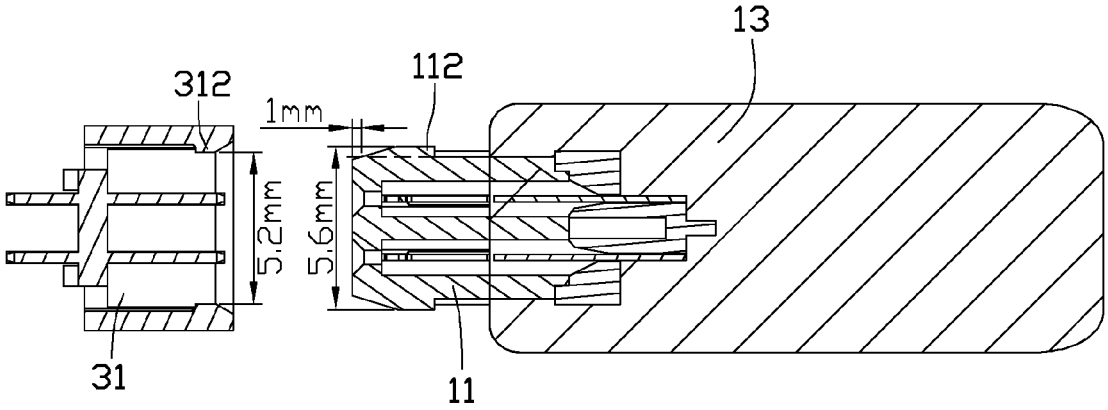
FIG. 5 is a cross-sectional view taken along line V-V of FIG. 1.

Referring to FIGS. 3 to 5, the USB socket 30 includes a housing 31. The housing 31 includes an upper panel, a lower panel parallel to the upper panel, and a pair of side panels. At least one pair of engaging protrusions 312 protrudes inwards from inner surfaces of the upper panel and from the lower panel. A U-shaped slot 315 is defined in the lower panel. In one embodiment, a distance between two engaging protrusions 312 which face each other is 5.2 millimeters (5.2 mm).

The USB connector 10 includes a holding portion 13, a header 11 extending from a first end of the holding portion 13, and a plurality of cables 15 attached to a second end of the holding portion 13.

The header 11 includes a pair of engaging walls 111 extending from the holding portion 13, and a front surface 117 between the pair of engaging walls 111. A slanting flange 118 slants inwards from each of the pair of engaging walls 111 and connects to the front surface 117 so as to present a bevel or chamfer. The front surface 117 is connected to each of the pair of engaging walls 111 via the slanting flange 118. The slanting flange 118 is oblique relative to the pair of engaging walls 111 and the front surface 117. At least one pair of clamping portions 112, protrudes from outer surfaces of the pair of engaging walls 111, to correspond to the at least one pair of engaging protrusions 312. A pair of grooves 113 is defined in the pair of engaging walls 111 and located behind the at least one pair of clamping portions 112. Each of the at least one pair of clamping portions 112 includes a flat surface 1124, substantially parallel to the pair of engaging walls 111, and a sloping surface 1122, connected between the flat surface 1124 and the slanting flange 118. A cross section of each of the at least one pair of clamping portions 112 is trapezoidal. A rectangular block 115 protrudes from one of the pair of engaging walls 111 to correspond to the U-shaped slot 315. In one embodiment, the distance from the outermost surface of one clamping portion 112 across to the outermost surface of the other clamping portion 112 is 5.6 mm. The joint line of the sloping surface 1122 and the slanting flange 118 is parallel to the front surface 117. A distance between the joint line and the front surface 117 is about 1 mm.

Figure 6:
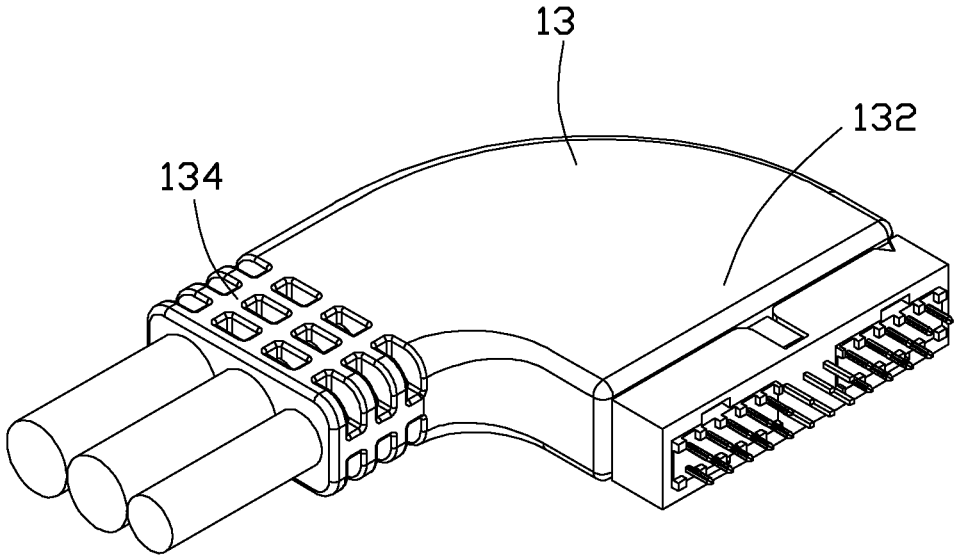
FIG. 6 is an assembled view of the assembly of FIG. 2.
Figure 7:
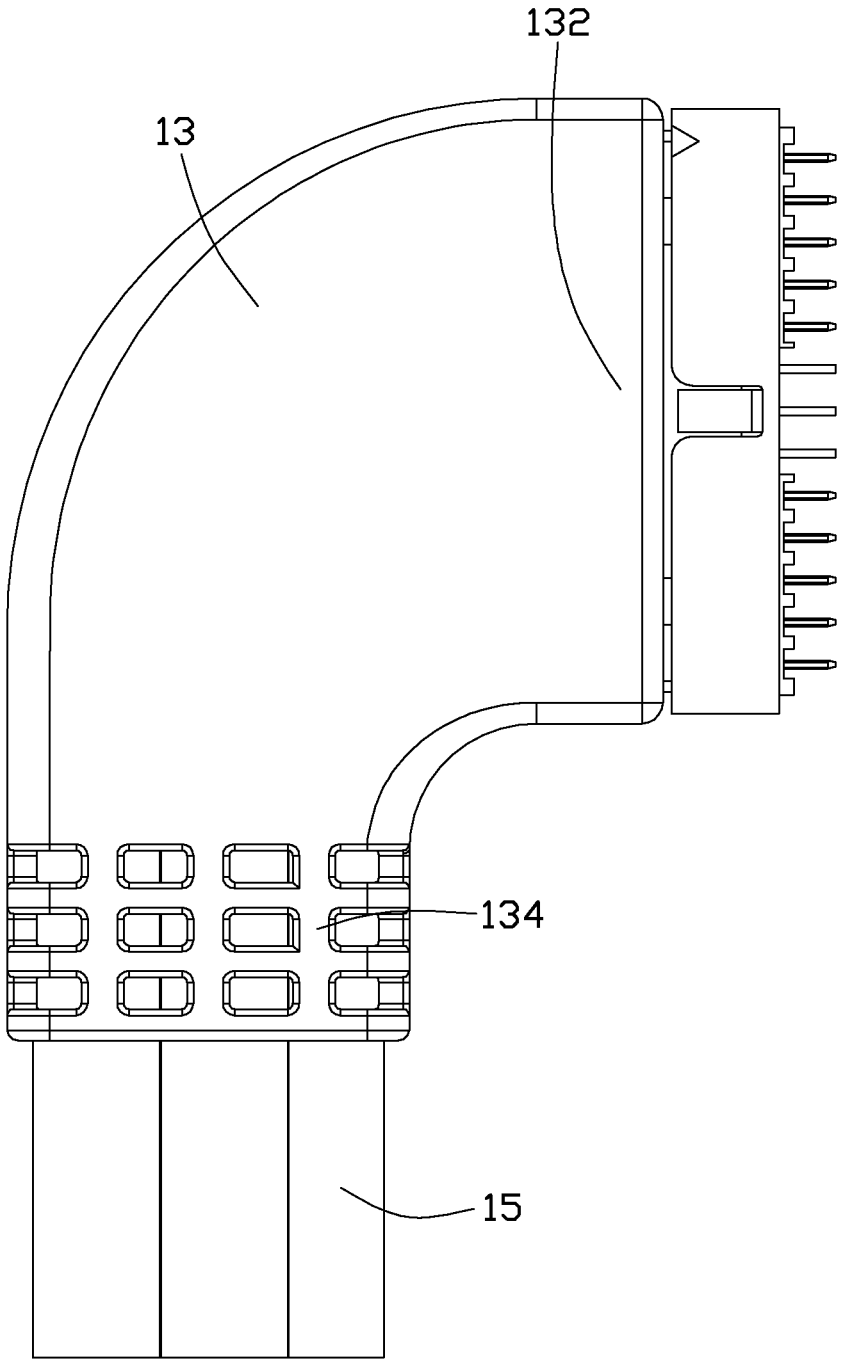
FIG. 7 is a plan view of the assembly of FIG. 6.

Referring to FIGS. 6 and 7, the holding portion 13 has a very compact shape and includes a first end 132 for holding the header 11 and a second end 134 for holding the plurality of cables 15. A width of the first end 132 is greater that that of the second end 134. The holding portion 13 includes a pair of parallel surfaces and two arc-shaped side surfaces substantially perpendicularly connected between the pair of parallel surfaces. The header 11 extends from the first end 132 along a first direction. The plurality of cables 15 extends from the second end 134 along a second direction, substantially perpendicular to the first direction. The plurality of cables 15 includes a cable used for transmitting USB 2.0 data and two cables used for transmitting USB 3.0 data.

Figure 8:
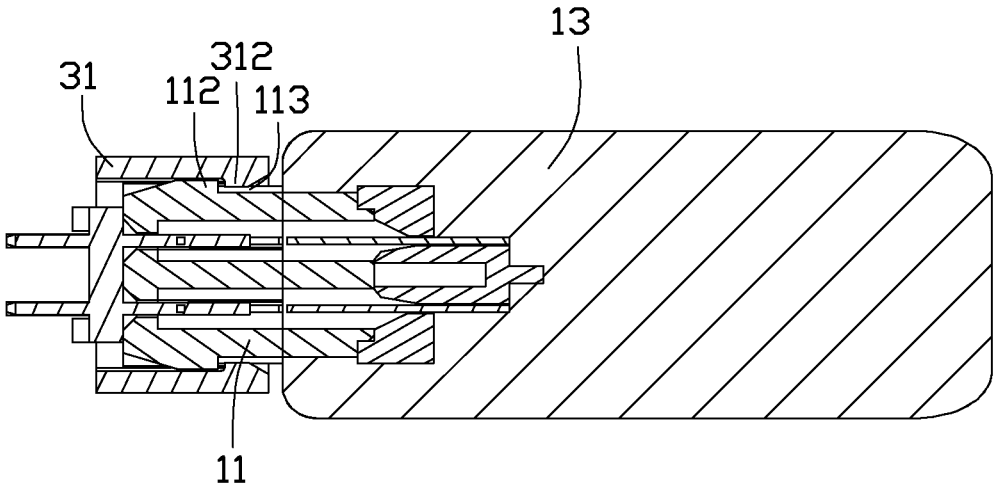
FIG. 8 is an assembled view of the assembly of FIG. 5.

Referring to FIG. 8, in assembly, the header 11 is inserted into the USB socket 30. The at least one pair of clamping portions 112 resists against the at least one pair of engaging protrusions 312. The housing 31 is expanded slightly until the at least one pair of engaging protrusions 312 engages in the pair of grooves 113. Rear surfaces of the at least one pair of clamping portions 112 resists against the at least one pair of engaging protrusions 312, thereby preventing the USB connector 10 from disengaging from the USB socket 30 without significant effort.

While the present disclosure has been illustrated by the description in this embodiment, and while the embodiment has been described in considerable detail, it is not intended to restrict or in any way limit the scope of the appended claims to such details. Additional advantages and modifications within the spirit and scope of the present disclosure will readily appear to those skilled in the art. Therefore, the present disclosure is not limited to the specific details and illustrative examples shown and described.

What is claimed is:

1. A connector assembly comprising:

a USB socket comprising a housing and a pair of engaging protrusions protruding from two opposite inner surfaces of the housing; and a USB connector comprising a holding portion; a header, extending from a first end of the holding portion, along a first direction, configured to be plugged into the USB socket; and a plurality of cables extending from a second end of the holding portion along a second direction, which is substantially perpendicular to the first direction; and a pair of clamping portions protruding from the header;

wherein the header comprises a pair of engaging walls, and the pair of clamping portions protrudes from the pair of engaging walls; the header further comprises a pair of slanting flanges extending slantingly from the pair of engaging walls; and a front surface is connected to and located between the pair of slanting flanges; each of the pair of clamping portions comprises a flat surface, substantially parallel to the pair of engaging walls; and a slanting surface extends from the flat surface to an edge of one of the pair of slanting flanges;

wherein when the header is inserted into the USB socket, the pair of clamping portions engages with the pair of engaging protrusions, for preventing the header from disengaging from the USB socket.

2. The connector assembly of claim 1, wherein a pair of grooves is defined in the header and located behind the pair of clamping portions, for receiving the pair of engaging protrusions.

3. The connector assembly of claim 1, wherein a distance defined between the pair of engaging protrusions is 5.2 millimeters.

4. The connector assembly of claim 1, wherein a distance defined between the edge and the front surface is about 1 millimeter.

5. The connector assembly of claim 4, wherein a cross section of each of the pair of clamping portions is trapezoid-shaped.

6. The connector assembly of claim 1, wherein the holding portion includes a pair of parallel walls and two arc-shaped side walls substantially perpendicularly connected to the pair of parallel walls; and a width of the first end is greater than that of the second end.

7. The connector assembly of claim 1, wherein a slot is defined in the housing, and a block protrudes from the header and is engaged with the slot.

8. A connector assembly comprising:

a USB socket comprising a housing and at least one engaging protrusion protruding from an inner surface of the housing; and a USB connector comprising a holding portion; a header, adapted to be plugged into the USB socket, extending from a first end of the holding portion, along a first direction; and a plurality of cables, extending from a second end of the holding portion, along a second direction substantially perpendicular to the first direction; and at least one groove defined in the header for receiving the at least one engaging protrusion and preventing the header from disengaging from the USB socket;

wherein at least one clamping portion protrudes from the header and is located in front of the at least one groove; the header comprises a pair of engaging walls, and the at least one clamping portion protrudes from one of the pair of engaging walls; the housing comprises a pair of opposite panels for engaging with the pair of engaging walls, a distance between the pair of opposite panels is less than a thickness of a thickest portion of the header; the header further comprises a pair of slanting flanges, extending slantingly from the pair of engaging walls; and a front surface, connected to and located between the pair of slanting flanges.

9. The connector assembly of claim 8, wherein the at least one clamping portion comprises a flat surface substantially parallel to the pair of engaging surfaces; and a slanting surface extending from the flat surface to an edge of one of the pair of slanting flanges.

10. The connector assembly of claim 9, wherein a distance between the edge and the front surface is about 1 millimeter.

11. The connector assembly of claim 10, wherein a cross section of each of the at least one clamping portion is trapezoid-shaped.

12. The connector assembly of claim 8, wherein the holding portion includes a pair of parallel walls and two arc-shaped side walls substantially perpendicularly connected to the pair of parallel walls; and a width of the first end is greater than that of the second end.

13. The connector assembly of claim 8, wherein a slot is defined in the housing, and a block protrudes from the header and engages with the slot.

* * * * *